US008947339B2

(12) United States Patent
Feng et al.

(10) Patent No.: US 8,947,339 B2
(45) Date of Patent: Feb. 3, 2015

(54) NOISE-COMPENSATED LCD DISPLAY

(75) Inventors: Xiao-fan Feng, Vancouver, WA (US); Scott J. Daly, Kalama, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 280 days.

(21) Appl. No.: 12/655,025

(22) Filed: Dec. 21, 2009

(65) Prior Publication Data

US 2011/0148900 A1 Jun. 23, 2011

(51) Int. Cl.
*G09G 3/36* (2006.01)
*G09G 3/34* (2006.01)

(52) U.S. Cl.
CPC ..... *G09G 3/3611* (2013.01); *G09G 3/3426* (2013.01); *G09G 2320/0646* (2013.01); *G09G 2320/066* (2013.01); *G09G 2360/16* (2013.01)
USPC ..... 345/102

(58) Field of Classification Search
CPC ..... G09G 3/3426
USPC ..... 345/102
See application file for complete search history.

(56) References Cited

U.S. PATENT DOCUMENTS

| | | | | |
|---|---|---|---|---|
| 7,405,741 | B1 | 7/2008 | Zhang et al. | |
| 7,505,018 | B2 | 3/2009 | Feng | |
| 2004/0246278 | A1* | 12/2004 | Elliott | 345/692 |
| 2005/0057486 | A1 | 3/2005 | Aoki et al. | |
| 2005/0184952 | A1* | 8/2005 | Konno et al. | 345/102 |
| 2005/0225575 | A1* | 10/2005 | Brown Elliott et al. | 345/694 |
| 2005/0248520 | A1* | 11/2005 | Feng et al. | 345/87 |
| 2005/0248524 | A1* | 11/2005 | Feng et al. | 345/102 |
| 2005/0248554 | A1* | 11/2005 | Feng et al. | 345/204 |
| 2005/0248555 | A1* | 11/2005 | Feng et al. | 345/204 |
| 2005/0248591 | A1* | 11/2005 | Feng et al. | 345/690 |
| 2005/0248592 | A1* | 11/2005 | Feng et al. | 345/690 |
| 2005/0248593 | A1* | 11/2005 | Feng et al. | 345/690 |
| 2006/0103621 | A1* | 5/2006 | Feng | 345/102 |
| 2006/0119613 | A1* | 6/2006 | Kerofsky | 345/590 |

(Continued)

FOREIGN PATENT DOCUMENTS

| | | | |
|---|---|---|---|
| JP | 2001-27890 | A | 1/2001 |
| JP | 2006-145798 | A | 6/2006 |

(Continued)

OTHER PUBLICATIONS

International Search Report and Written Opinion, dated Oct. 5, 2010 in co-pending International Appl. No. PCT/JP2010/060697, filed Jun. 17, 2010, 9 pgs.

(Continued)

*Primary Examiner* — Claire X Pappas
*Assistant Examiner* — Robert Stone
(74) *Attorney, Agent, or Firm* — Chernoff Vilhauer McClung & Stenzel, LLP

(57) ABSTRACT

A method for displaying an input image on a display includes receiving the input image to be displayed on the display. The image is modified with a first process to determine a driving signal for a two-dimensional backlight array of independently selectable light emitting elements of the display. The first modified image is modified with a second noise reducing process to determine a driving signal for a two-dimensional liquid crystal layer defining pixels of the display. The two-dimensional backlight array has a different density of light emitting elements than the two-dimensional liquid crystal layer defining the pixels of the display.

15 Claims, 9 Drawing Sheets

(56) References Cited

U.S. PATENT DOCUMENTS

| | | | | |
|---|---|---|---|---|
| 2006/0125771 | A1* | 6/2006 | Inuzuka et al. | 345/102 |
| 2006/0209003 | A1* | 9/2006 | Kerofsky | 345/102 |
| 2006/0232544 | A1* | 10/2006 | Sakashita | 345/102 |
| 2006/0274026 | A1* | 12/2006 | Kerofsky | 345/102 |
| 2006/0284823 | A1* | 12/2006 | Kerofsky et al. | 345/102 |
| 2007/0222740 | A1* | 9/2007 | Hanada | 345/102 |
| 2007/0262948 | A1 | 11/2007 | Han | |
| 2007/0285382 | A1 | 12/2007 | Feng | |
| 2008/0084432 | A1* | 4/2008 | Jeon | 345/690 |
| 2008/0129677 | A1* | 6/2008 | Li et al. | 345/102 |
| 2008/0273005 | A1 | 11/2008 | Chen | |
| 2008/0291153 | A1* | 11/2008 | Zhang et al. | 345/102 |
| 2009/0015539 | A1 | 1/2009 | Rumreich | |
| 2009/0092325 | A1* | 4/2009 | Brown Elliott et al. | 382/232 |
| 2009/0115718 | A1 | 5/2009 | Qiao et al. | |
| 2009/0174638 | A1* | 7/2009 | Brown Elliott et al. | 345/88 |
| 2009/0262067 | A1* | 10/2009 | Feng et al. | 345/102 |
| 2009/0295706 | A1* | 12/2009 | Feng | 345/102 |
| 2010/0238189 | A1* | 9/2010 | Feng | 345/589 |
| 2010/0238201 | A1* | 9/2010 | Nonaka et al. | 345/690 |
| 2011/0057945 | A1* | 3/2011 | Matsubara | 345/589 |
| 2011/0291919 | A1* | 12/2011 | Kerofsky et al. | 345/102 |

FOREIGN PATENT DOCUMENTS

| | | | |
|---|---|---|---|
| JP | 2008-139871 | A | 6/2008 |
| JP | 2009-139641 | A | 6/2009 |
| JP | 2009-192963 | A | 8/2009 |
| WO | 2006060666 | A3 | 6/2006 |
| WO | 2009096068 | A1 | 8/2009 |

OTHER PUBLICATIONS

Matt Buchanan, "Giz Explains: What's So Great About LED-Backlit LCDs," May 27, 2009, XP-002691137, retrieved Jan. 29, 2013 from the internet: URL:http://gizmodo.com/5271493/giz-explains-whats-so-great-about-led+backlit-lcds, 4 pgs.

Supplementary European Search Report, Application No. 10839009.7-1903 / 2504734, PCT/JP2010/060697, Sharp Kabushiki Kaisha, Feb. 18, 2013, 3 pgs.

European Official Communication, Application No. 10839009.7-1903, Sharp Kabushiki Kaisha, Oct. 4, 2013, 10 pgs.

Japanese Office Action, mailed Nov. 19, 2013, for Japanese Patent Application No. 2012-542708, corresponding to PCT/JP2010/060697, filed Jun. 17, 2010, 3 pgs.

English translation of Japanese Office Action, mailed Nov. 19, 2013, for Japanese Patent Application No. 2012-542708, corresponding to PCT/JP2010/060697, filed Jun. 17, 2010, 4 pgs.

Chinese Official Action, dated May 9, 2014, Chinese Patent App. No. 201080057969.2, Sharp Kabushiki Kaisha, 9 pgs.

* cited by examiner

NOISE-COMPENSATED LCD DISPLAY

CROSS-REFERENCE TO RELATED APPLICATIONS

Not applicable.

BACKGROUND OF THE INVENTION

The present invention relates generally to displaying an image on a LCD display.

The local transmittance of a liquid crystal display (LCD) panel or a liquid crystal on silicon (LCOS) display can be varied to modulate the intensity of light passing from a backlit source through an area of the panel to produce a pixel that can be displayed at a variable intensity. Whether light from the source passes through the panel to an observer or is blocked, is determined by the orientations of molecules of liquid crystals in a light valve.

Since liquid crystals do not emit light, a visible display requires an external light source. Small and inexpensive LCD panels often rely on light that is reflected back toward the viewer after passing through the panel. Since the panel is not completely transparent, a substantial part of the light is absorbed during its transits of the panel and images displayed on this type of panel may be difficult to see except under the best lighting conditions. On the other hand, LCD panels used for computer displays and video screens are typically backlit with fluorescent tubes or arrays of light-emitting diodes (LEDs) that are built into the sides or back of the panel. To provide a display with a more uniform light level, light from these point or line sources is typically dispersed in a diffuser panel before impinging on the light valve that controls transmission to a viewer.

The transmittance of the light valve is controlled by a layer of liquid crystals interposed between a pair of polarizers. Light from the source impinging on the first polarizer comprises electromagnetic waves vibrating in a plurality of planes. Only that portion of the light vibrating in the plane of the optical axis of a polarizer can pass through the polarizer. In a LCD the optical axes of the first and second polarizers are arranged at an angle so that light passing through the first polarizer would normally be blocked from passing through the second polarizer in the series. However, a layer of translucent liquid crystals occupies a cell gap separating the two polarizers. The physical orientation of the molecules of liquid crystal can be controlled and the plane of vibration of light transiting the columns of molecules spanning the layer can be rotated to either align or not align with the optical axes of the polarizers.

The surfaces of the first and second polarizers forming the walls of the cell gap are grooved so that the molecules of liquid crystal immediately adjacent to the cell gap walls will align with the grooves and, thereby, be aligned with the optical axis of the respective polarizer. Molecular forces cause adjacent liquid crystal molecules to attempt to align with their neighbors with the result that the orientation of the molecules in the column spanning the cell gap twist over the length of the column. Likewise, the plane of vibration of light transiting the column of molecules will be "twisted" from the optical axis of the first polarizer to that of the second polarizer. With the liquid crystals in this orientation, light from the source can pass through the series polarizers of the translucent panel assembly to produce a lighted area of the display surface when viewed from the front of the panel.

To darken a pixel and create an image, a voltage, typically controlled by a thin film transistor, is applied to an electrode in an array of electrodes deposited on one wall of the cell gap. The liquid crystal molecules adjacent to the electrode are attracted by the field created by the voltage and rotate to align with the field. As the molecules of liquid crystal are rotated by the electric field, the column of crystals is "untwisted," and the optical axes of the crystals adjacent the cell wall are rotated out of alignment with the optical axis of the corresponding polarizer progressively reducing the local transmittance of the light valve and the intensity of the corresponding display pixel. Color LCD displays are created by varying the intensity of transmitted light for each of a plurality of primary color elements (typically, red, green, and blue) that make up a display pixel.

LCDs can produce bright, high resolution, color images and are thinner, lighter, and draw less power than cathode ray tubes (CRTs). As a result, LCD usage is pervasive for the displays of portable computers, digital clocks and watches, appliances, audio and video equipment, and other electronic devices. On the other hand, the use of LCDs in certain "high end markets," such as medical imaging and graphic arts, may demand an even greater dynamic range than available with cathode tube backlight based LCDs.

The primary efforts to increase the dynamic range of LCDs have been traditionally directed to improving the properties of materials used in LCD construction. As a result of these efforts, the dynamic range of LCDs has increased since their introduction and high quality LCDs can achieve dynamic ranges of 300:1 or more. This is comparable to the dynamic range of an average quality CRT when operated in a well-lit room but is considerably less than the 1000:1 dynamic range that can be obtained with a well-calibrated CRT in a darkened room or dynamic ranges of up to 3000:1 that can be achieved with certain plasma displays.

Another type of LCD display construction is to include a light emitting diode based backlight array. Such an array permits the individual selection of the luminance for individual elements of the backlight array. By selective illumination of the individual elements, different regions of the display may be selectively dimmed or otherwise turned off, which increases the dynamic range of the display. Such a display technique may achieve an even greater dynamic range than a high quality CRT or typical cold cathode fluorescent light based LCD displays. The range of intensity values of image pixels may be modified to account for the increased dynamic range of the display. Unfortunately, the resulting images displayed tend to exhibit substantial noise and contouring artifacts, especially in the darker regions of the images.

What is desired is a display system that reduces the noise and contouring artifacts, especially in high dynamic range displays.

The foregoing and other objectives, features, and advantages of the invention will be more readily understood upon consideration of the following detailed description of the invention, taken in conjunction with the accompanying drawings.

DETAILED DESCRIPTION OF PREFERRED EMBODIMENT

Figure 1:
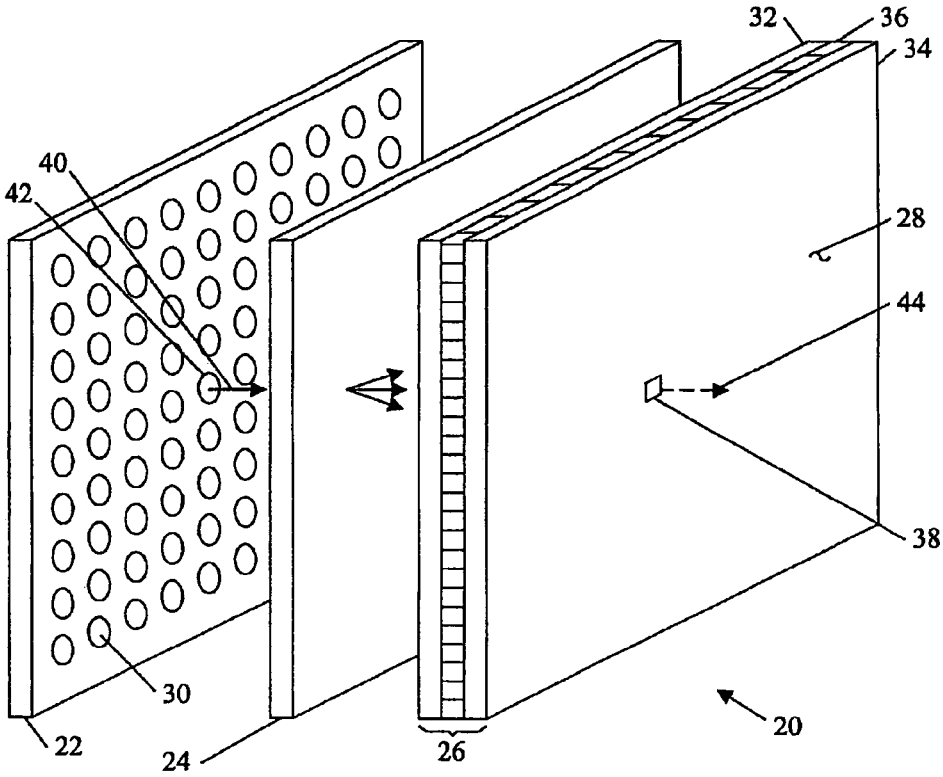
FIG. 1 illustrates a display.

Referring to FIG. 1, a backlit display 20 comprises, generally, a backlight 22, a diffuser 24, and a light valve 26 (indicated by a bracket) that controls the transmittance of light from the backlight 22 to a user viewing an image displayed at the front of the panel 28. The light valve, typically comprising a liquid crystal apparatus, is arranged to electronically control the transmittance of light for a picture element or pixel. Since liquid crystals do not emit light, an external source of light is necessary to create a visible image. The source of light for small and inexpensive LCDs, such as those used in digital clocks or calculators, may be light that is reflected from the back surface of the panel after passing through the panel. Likewise, liquid crystal on silicon (LCOS) devices rely on light reflected from a backplane of the light valve to illuminate a display pixel. However, LCDs absorb a significant portion of the light passing through the assembly and an artificial source of light such as the backlight 22 comprising fluorescent light tubes or an array of light sources 30 (e.g., light-emitting diodes (LEDs)), as illustrated in FIG. 1, is used to produce pixels of sufficient intensity for highly visible images or to illuminate the display in poor lighting conditions. There may not be a light source 30 for each pixel of the display and, therefore, the light from the point or line sources is typically dispersed by a diffuser panel 24 so that the lighting of the front surface of the panel 28 is more uniform. In most cases, the density of light sources is substantially less than that of the individual pixels of the liquid crystal layer.

Light radiating from the light sources 30 of the backlight 22 comprises electromagnetic waves vibrating in random planes. Only those light waves vibrating in the plane of a polarizer's optical axis can pass through the polarizer. The light valve 26 includes a first polarizer 32 and a second polarizer 34 having optical axes arrayed at an angle so that normally light cannot pass through the series of polarizers. Images are displayable with an LCD because local regions of a liquid crystal layer 36 interposed between the first 32 and second 34 polarizer can be electrically controlled to alter the alignment of the plane of vibration of light relative of the optical axis of a polarizer and, thereby, modulate the transmittance of local regions of the panel corresponding to individual pixels 36 in an array of display pixels.

The layer of liquid crystal molecules 36 occupies a cell gap having walls formed by surfaces of the first 32 and second 34 polarizers. The walls of the cell gap are rubbed to create microscopic grooves aligned with the optical axis of the corresponding polarizer. The grooves cause the layer of liquid crystal molecules adjacent to the walls of the cell gap to align with the optical axis of the associated polarizer. As a result of molecular forces, each succeeding molecule in the column of molecules spanning the cell gap will attempt to align with its neighbors. The result is a layer of liquid crystals comprising innumerable twisted columns of liquid crystal molecules that bridge the cell gap. As light 40 originating at a light source element 42 and passing through the first polarizer 32 passes through each translucent molecule of a column of liquid crystals, its plane of vibration is "twisted" so that when the light reaches the far side of the cell gap its plane of vibration will be aligned with the optical axis of the second polarizer 34. The light 44 vibrating in the plane of the optical axis of the second polarizer 34 can pass through the second polarizer to produce a lighted pixel 38 at the front surface of the display 28.

To darken the pixel 38, a voltage is applied to a spatially corresponding electrode of a rectangular array of transparent electrodes deposited on a wall of the cell gap. The resulting electric field causes molecules of the liquid crystal adjacent to the electrode to rotate toward alignment with the field. The effect is to "untwist" the column of molecules so that the plane of vibration of the light is progressively rotated away from the optical axis of the polarizer as the field strength increases and the local transmittance of the light valve 26 is reduced. As the transmittance of the light valve 26 is reduced, the pixel 38 progressively darkens until the maximum extinction of light 40 from the light source 42 is obtained. Color LCD displays are created by varying the intensity of transmitted light for each of a plurality of primary color elements (typically, red, green, and blue) elements making up a display pixel.

In the backlit display 20 with extended dynamic range, the backlight 22 comprises an array of locally controllable light sources 30. The individual light sources 30 of the backlight may be light-emitting diodes (LEDs), an arrangement of phosphors and lenslets, or other suitable light-emitting devices. The individual light sources 30 of the backlight array 22 are independently controllable to output light at a luminance level independent of the luminance level of light output by the other light sources so that a light source can be modulated in response to the luminance of the corresponding image pixel.

A data processing unit may extract the luminance of the display pixel from the pixel data if the image is a color image. For example, the luminance signal can be obtained by a weighted summing of the red, green, and blue (RGB) components of the pixel data (e.g., 0.33R+0.57G+0.11B). If the image is a black and white image, the luminance is directly available from the image data and the extraction step can be omitted. The luminance signal may be low-pass filtered with a filter having parameters determined by the illumination profile of the light source 30 as affected by the diffuser 24 and properties of the human visual system. Following filtering, the signal is subsampled to obtain a light source illumination signal at spatial coordinates corresponding to the light sources 30 of the backlight array 22. As the rasterized image pixel data are sequentially used to drive the display pixels of the LCD light valve 26, the subsampled luminance signal is used to output a power signal to the light source driver to drive the appropriate light source to output a luminance level according a relationship between the luminance of the image pixel and the luminance of the light source. Modulation of the backlight light sources 30 increases the dynamic range of the LCD pixels primarily by attenuating illumination of "darkened" pixels while the luminance of a "fully on" pixel is typically unchanged.

Figure 2:
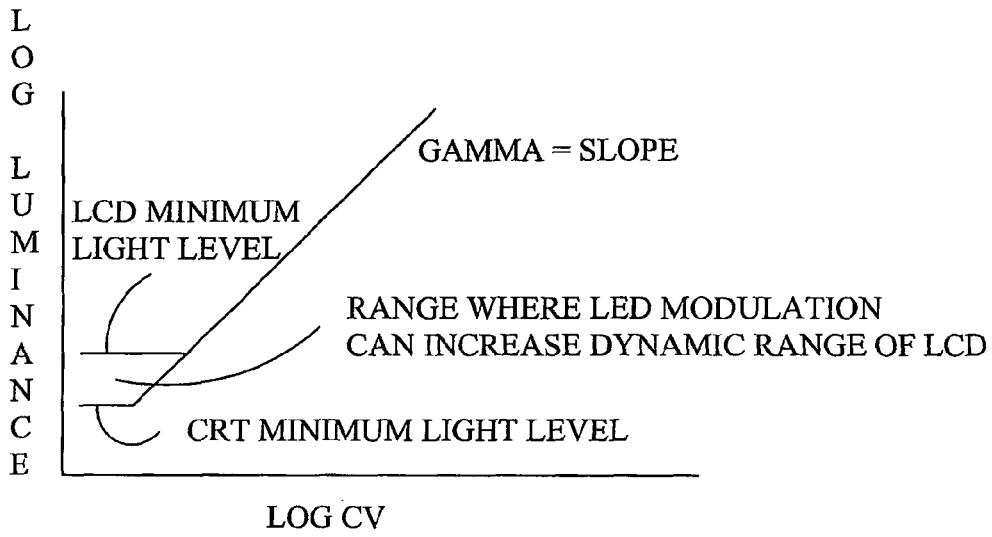
FIG. 2 illustrates different luminance ranges.

Referring to FIG. 2, the luminance versus image code values is illustrated for both a CRT display and a traditional LCD display with a cold cathode fluorescent light based backlight. As it may be observed, the minimum light level of the traditional LCD is greater than that of the minimum light level of the CRT. Modern LCD displays and modern LED based backlight displays can increase the dynamic range of the LCD display to match or even exceed CRT based displays.

Figure 3:
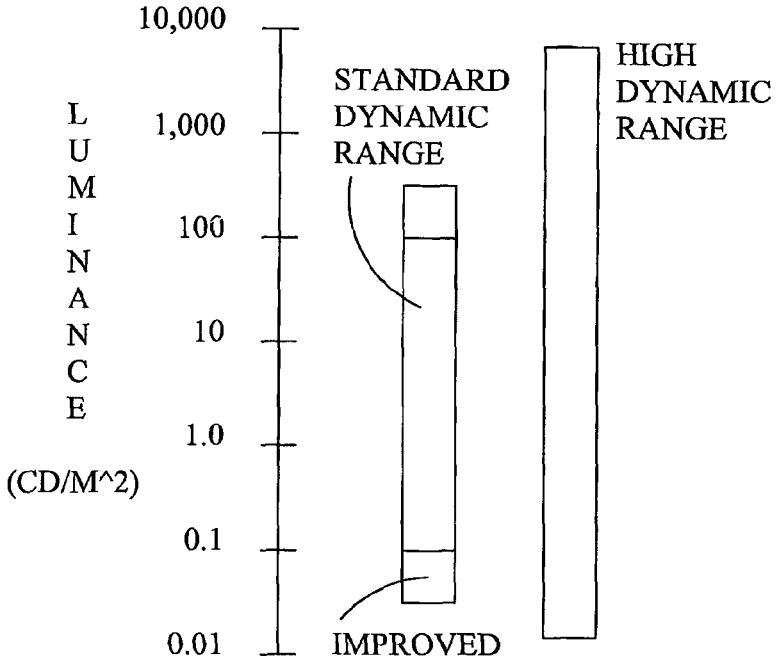
FIG. 3 illustrates different dynamic ranges.

Referring to FIG. 3, another illustration graphically illustrates the increase in the dynamic range of displays. The traditional dynamic range of the display is shown, where the input data for the image normally had a bit depth of eight. With improved backlight technology, such as light emitting diodes directed from the periphery of the display, the dynamic range increased somewhat. The input data for the image normally retains the input image bit depth of eight, while the contrast indicated by corresponding code values increases somewhat. The image displayed on the standard LCD and improved LCD has a similar appearance. A "high" dynamic range display typically has an array of LEDs (or other selective light emitting elements) arranged to selectively illuminate different portions of the display. The input data for the image normally retains the input image bit depth of eight, while the contrast per code value indicated by the corresponding code values increases significantly. In some cases, the bit depth of the image is internally increased within the display for processing. The resulting image displayed having a more significant increase in the contrast with code values tends to result in more significant image artifacts, such as contour artifacts and noise boosting. The noise boosting tends to be especially strong in the dark region of the tone scale where the quantum noise and dark current noise tends to dominate.

Figure 4:
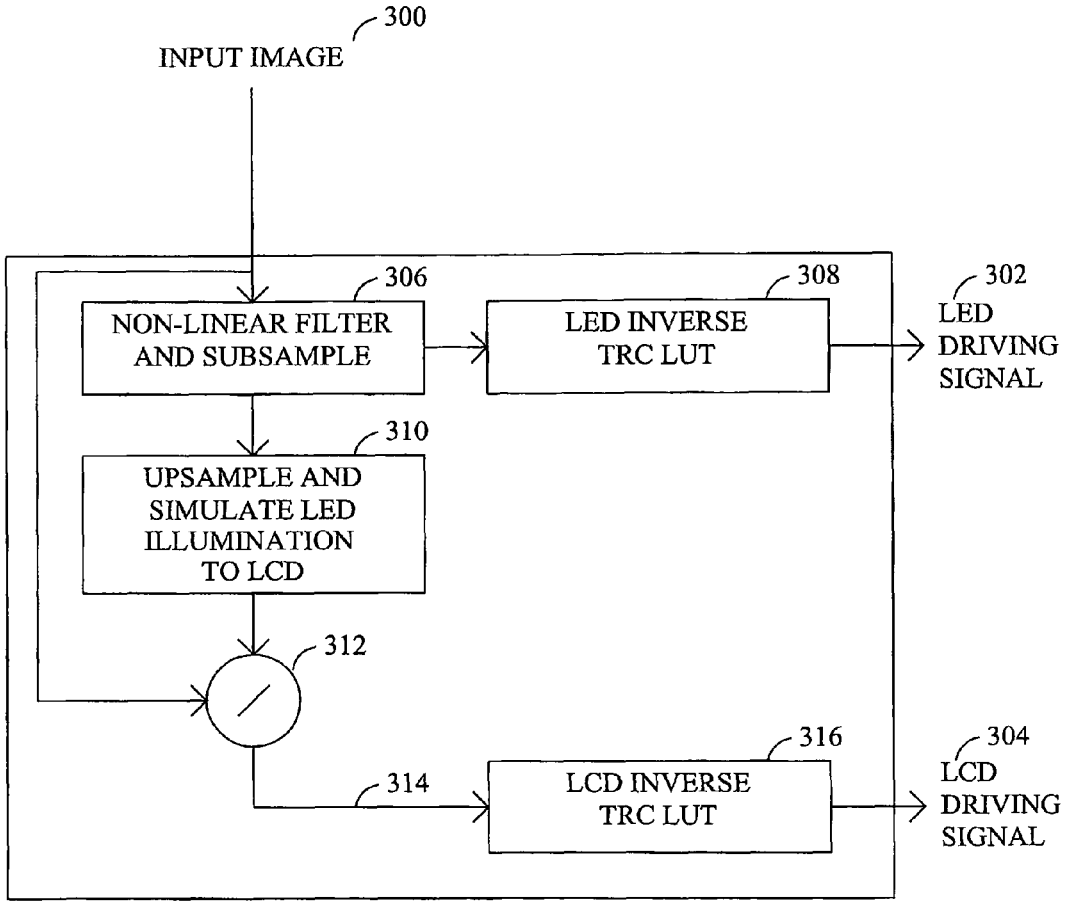
FIG. 4 illustrates a filtering technique.

Referring to FIG. 4, an input image 300 is processed to provide a LED driving signal 302 to the LED layer and an LCD driving signal 304 to the LCD layer of the display. The input image 300 may be non-linear filtered and sub-sampled 306 in accordance with the LED array. A look up table 308 based upon an LED inverse tone response curve ("TRC") is used on the filtered sub-sampled 306 image data to provide the LED driving signal 302. The non-linear sub-sampled 306 image is up-sampled and modified 310 to simulate the illumination of the LED layer. The input image 300 is divided 312 by the up-sampled image 310. The resulting image 314 together with the backlight should accurately simulate the input image 300. A look up table 316 based upon the LCD inverse TRC is used on the resulting image 314 image data. The resulting data from the LUT 316 is provided as the LCD driving signal 304. Unfortunately, visible noise tends to result from high dynamic range displays, especially strong in the dark region of the tone scale where the quantum noise and dark current noise tends to dominate.

Figure 5:
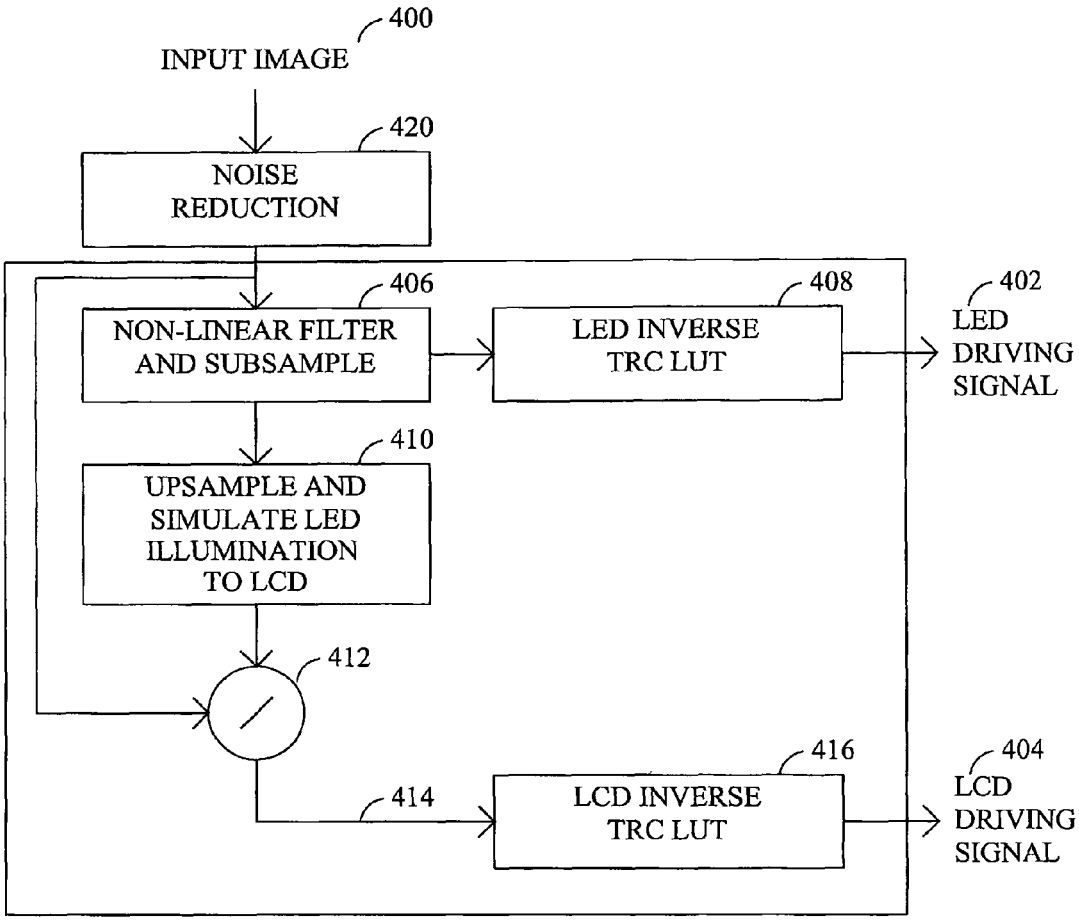
FIG. 5 illustrates a filtering technique.

Referring to FIG. 5, one potential way to reduce visible noise, an input image 400 is processed by a noise reduction process 420. The noise reduction 420 may include a low pass filter to attenuate the high frequency content, any filter, a coring operation, subsampling, or otherwise. The noise reduced image 420 is processed to provide an LED driving signal 402 to the LED layer and an LCD driving signal 404 to the LCD layer of the display. The noise reduced image 420 may be non-linear filtered and sub-sampled 406 in accordance with the LED array. A look up table 408 based upon an LED inverse TRC is used on the filtered sub-sampled 406 image data to provide the LED driving signal 402. The non-linear sub-sampled 406 image is up-sampled and modified 410 to simulate the illumination of the LED layer. The filtered input image 420 is divided 412 by the up-sampled image 410. The resulting image 414 together with the backlight should accurately simulate the input image 400. A look up table 416 based upon the LCD inverse TRC is used on the resulting image 414 image data. The resulting data from the LUT 416 is provided as the LCD driving signal 404. Unfortunately, visible noise tends to result from high dynamic range displays, even with noise reduction 420, being especially strong in the dark region of the tone scale where the quantum noise and dark current noise tends to dominate.

The problem with this technique of pre-filtering the image is that the noise signal in the problematic areas are very low, such as 1 or 2 code values, and signals of importance are in this range as well. Normally such code value differences are difficult to see (especially in the dark end of the tone scale), particularly for noise which has significant high frequency content (and thus below threshold due to high spatial frequency). However, once the contrast/code value is increased by a higher dynamic range display, these values get amplified in the luminance domain, and rise above the visual threshold.

Figure 6:
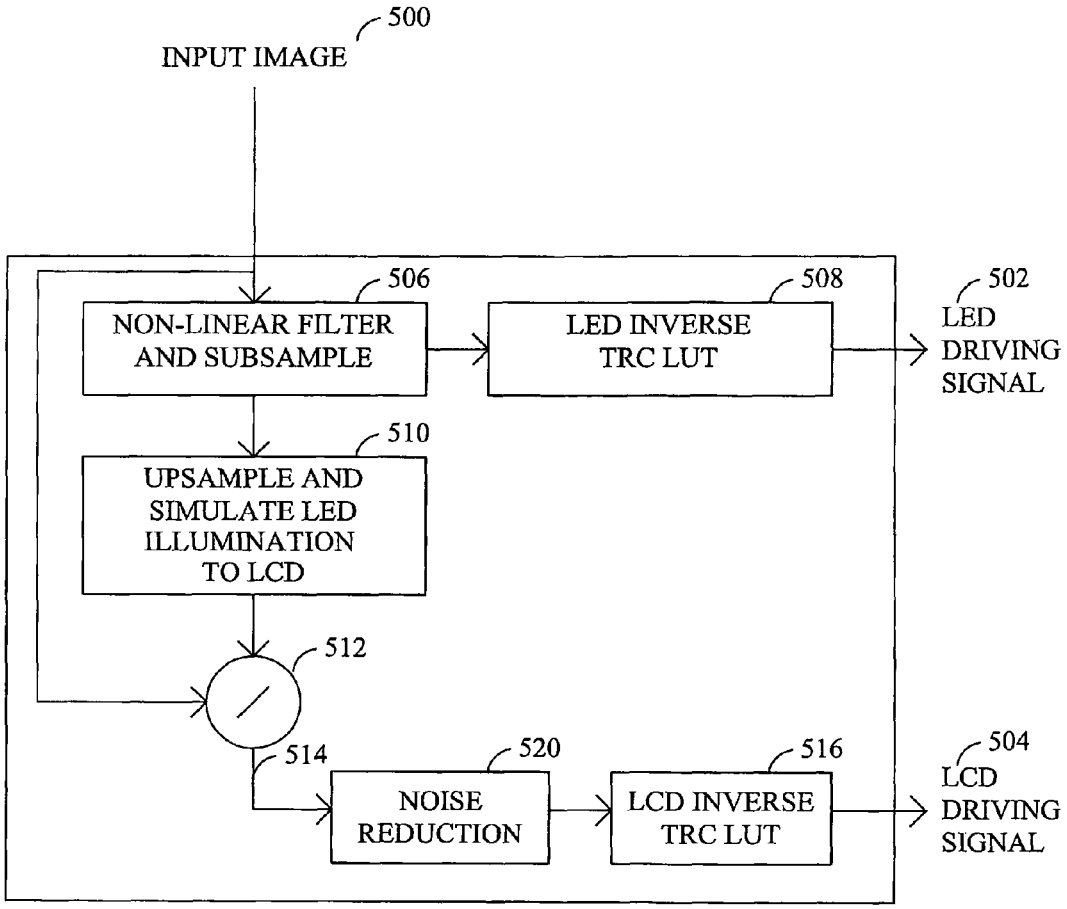
FIG. 6 illustrates a filtering technique.

Referring to FIG. 6, an input image 500 is processed to provide an LED driving signal 502 to the LED layer and an LCD driving signal 504 to the LCD layer of the display. The input image 500 may be non-linear filtered and sub-sampled 506 in accordance with the LED array. A look up table 508 based upon an LED inverse TRC is used on the filtered sub-sampled 506 image data to provide the LED driving signal 502. The non-linear sub-sampled 506 image is up-sampled and modified 510 to simulate the illumination of the LED layer. The input image 500 is divided 512 by the up-sampled image 510. The resulting image 514 (after LUT 516) together with the backlight should accurately simulate the input image 500. Unfortunately, the resulting image 514 will result in readily visible noise that rises above the visual threshold, due in part to the contrast/code value increase. A noise reduction process 520 may receive the resulting image 514. The process 520 may include a low pass filter, any filter, a coring operation, subsampling, or otherwise. A look up table 516 based upon the LCD inverse TRC is used on the resulting image 514 image data. The resulting data from the LUT 516 is provided as the LCD driving signal 504.

The noise reduction process 520 may be a denoising filter or other spatial enhancement filter applied to the resulting image 514. That is, the modification is applied to the image after the input image has been divided by the simulated LED light intensity array. This division amplifies the code values. Further, since the division is normally done at a higher contrast per code value, the various code values having noise of amplitudes +/−1 or 2 have a much larger range, as well as higher amplitude resolution (because the LED simulation is done at a higher amplitude resolution than the input image). These factors give the denoising technique more leverage in separating signal from noise when performed after the image division step. This denoising step is preferably performed after the division step, but before the LCD TRC calibration step. That is, the denoising step is preferably done in conjunction within the LED-LCD separation technique.

Figure 7:
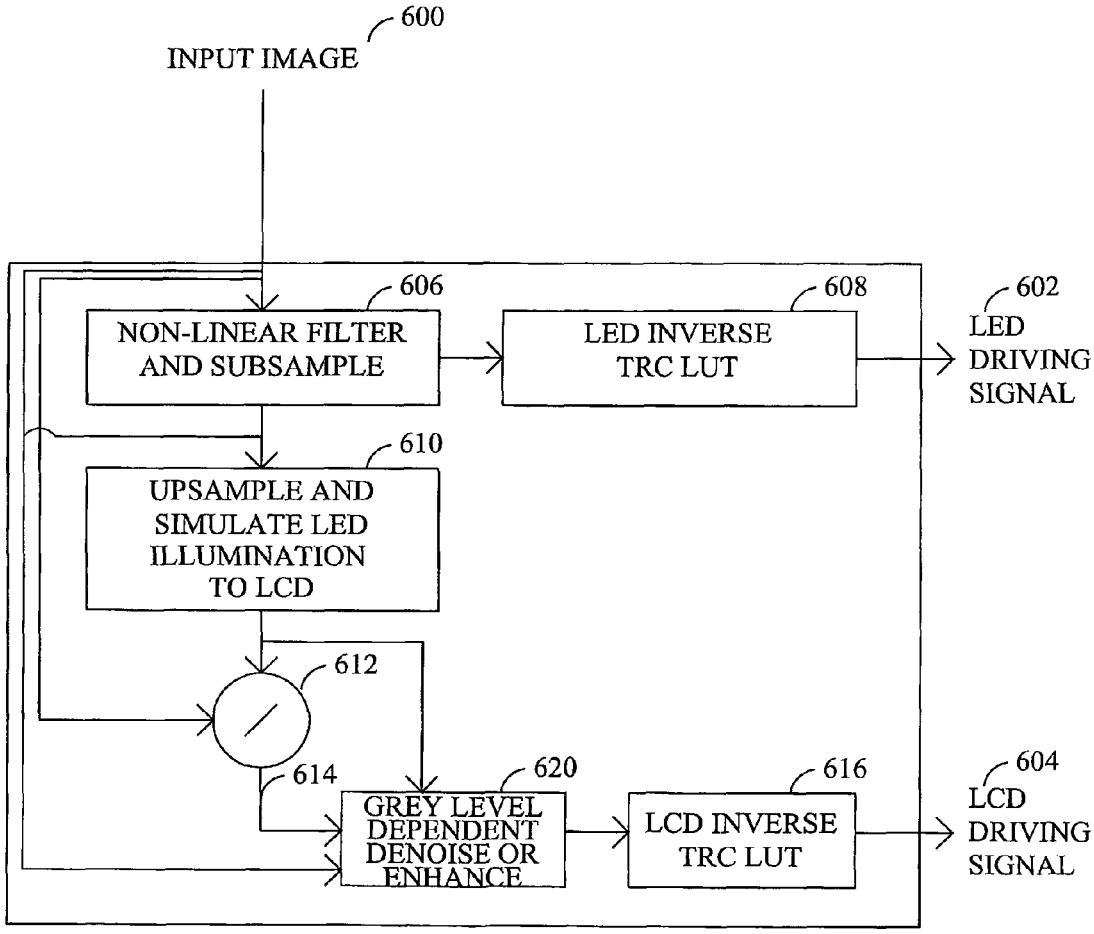
FIG. 7 illustrates a filtering technique.

Referring to FIG. 7, an input image 600 is processed to provide an LED driving signal 602 to the LED layer and an LCD driving signal 604 to the LCD layer of the display. The input image 600 may be non-linear filtered and sub-sampled 606 in accordance with the LED array. A look up table 608 based upon an LED inverse TRC is used on the filtered sub-sampled 606 image data to provide the LED driving signal 602. The non-linear sub-sampled 606 image is up-sampled and modified 610 to simulate the illumination of the LED layer. The input image 600 is divided 612 by the up-sampled image 610. The resulting image 614 (after LUT 616) together with the backlight should accurately simulate the input image 600. Unfortunately, the resulting image 614 will result in readily visible noise that rises above the visual threshold, due in part to the contrast/code value increase. A noise reduction process 620 may receive the resulting image 614. The process 620 may include a low pass filter, any filter, a coring operation, subsampling, or otherwise. A look up table 616 based upon the LCD inverse TRC is used on the resulting image 614 image data. The resulting data from the LUT 616 is provided as the LCD driving signal 604.

The noise reduction process 620 may be a denoising filter or other spatial enhancement filter applied to the LCD resulting image 614. That is, the modification is applied to the image after the input image has been divided by the simulated LED light intensity array. This division amplifies the code values. Further, since the division is normally done at a higher contrast per code value, the various code values having noise of amplitudes +/−1 or 2 have a much larger range, as well as higher amplitude resolution (because the LED simulation is done at a higher amplitude resolution than the input image). These factors give the denoising technique more leverage in separating signal from noise when performed after the image division step. This denoising step is preferably performed after the division step, but before the LCD TRC calibration step. That is, the denoising step is preferably done in conjunction within the LED-LCD separation technique. The process 620 may further include a gray level dependency in the denoising technique that is determined not from the resulting image 614 upon which the denoising technique is applied (coming out of the division step), but rather, is determined based upon the LED image. It can be determined from the LED layer after upsampling and other simulation steps (preferred embodiment), or it can be determined from the sub-sampled LED image, or it can be determined from the input image 600.

Figure 8:
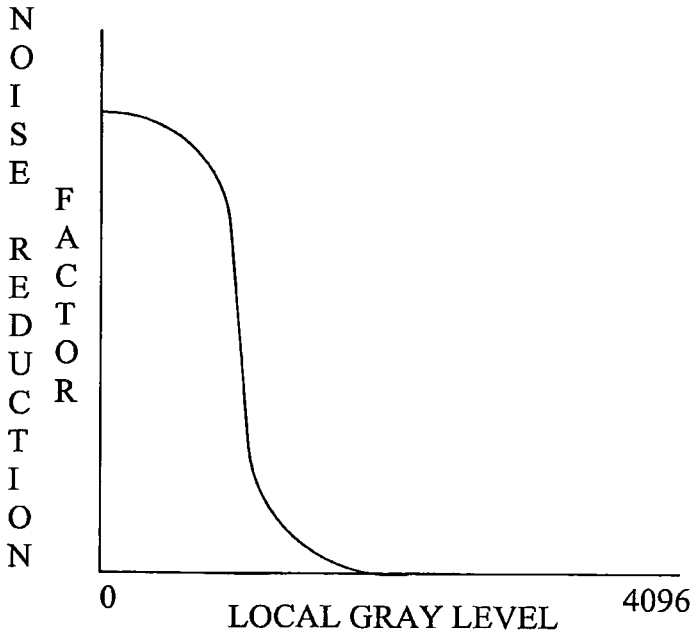
FIG. 8 illustrates a gray level curve.

Referring to FIG. 8, a preferred technique for reducing noise based upon gray levels is tailored for the typical noise visibility using a curve. The gray level input from the LED layer may have a 12 bits (0-4096) range. The dark end may be at 0. The noise reduction factor is used on the LCD layer as a denoising parameter. The preferred technique has a strong noise reduction for the dark areas of the final displayed image.

Another technique uses edge selective noise reduction where an edge map also controls the noise reduction factor. The typical polarity of that process is to have weak or no noise reduction around edges.

Figure 9:
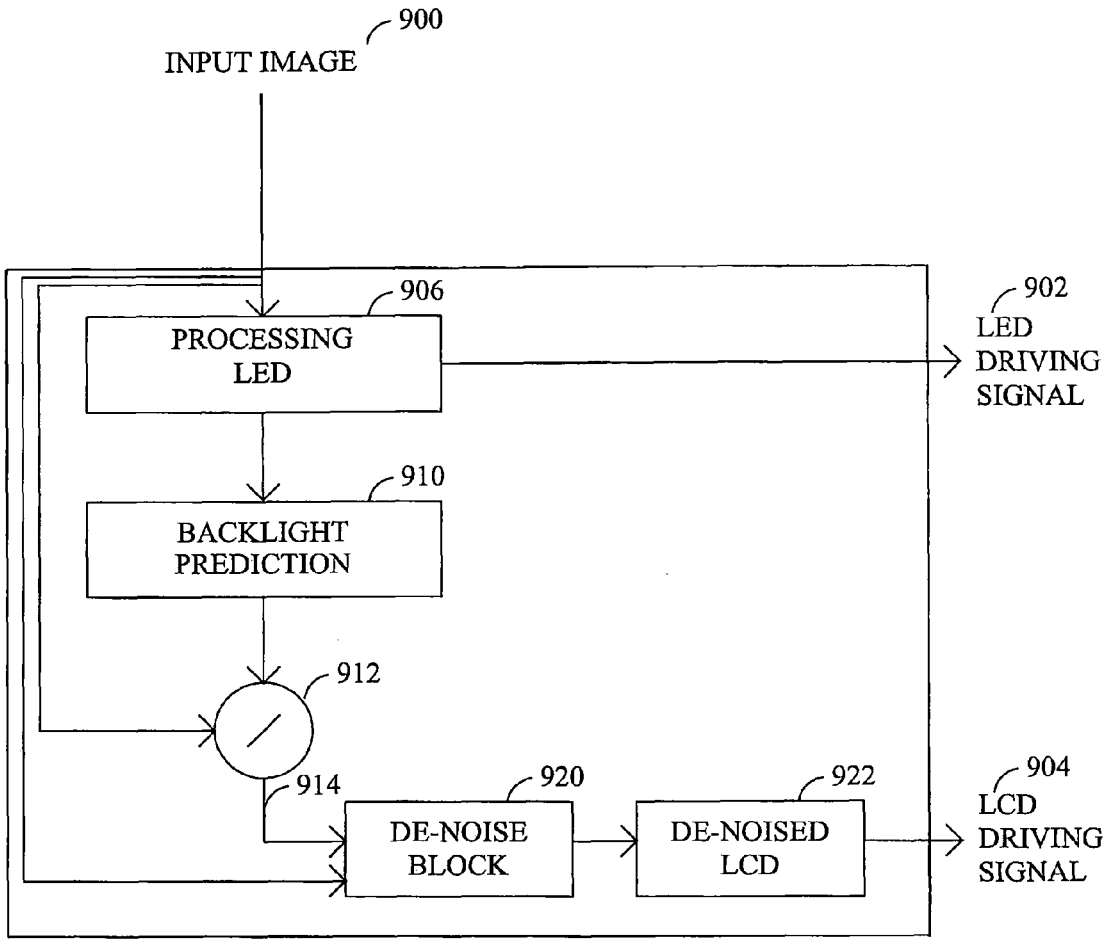
FIG. 9 illustrates a denoising technique

FIG. 9 illustrates a noise reduction technique. An input image 900 is received upon which the a led driving signal 902 is determined based upon LED processing 906. The LED process 906 may include non-liner filtering, sub-sampling, and/or a look up table. Based upon the LED process 906 a prediction of the backlight is simulated 910. A division operation 912 devices the input image 900 by the backlight prediction 910. A resulting LCD image 914 is obtained as a result of the division operation 912. A noise reduction process 920 is performed based upon the input image 900 and the LCD image 914 resulting in a noise reduced image 922. A look up table may be used to adjust the tone curve and provided as a LCD signal 904 to the LCD layer.

Figure 10:
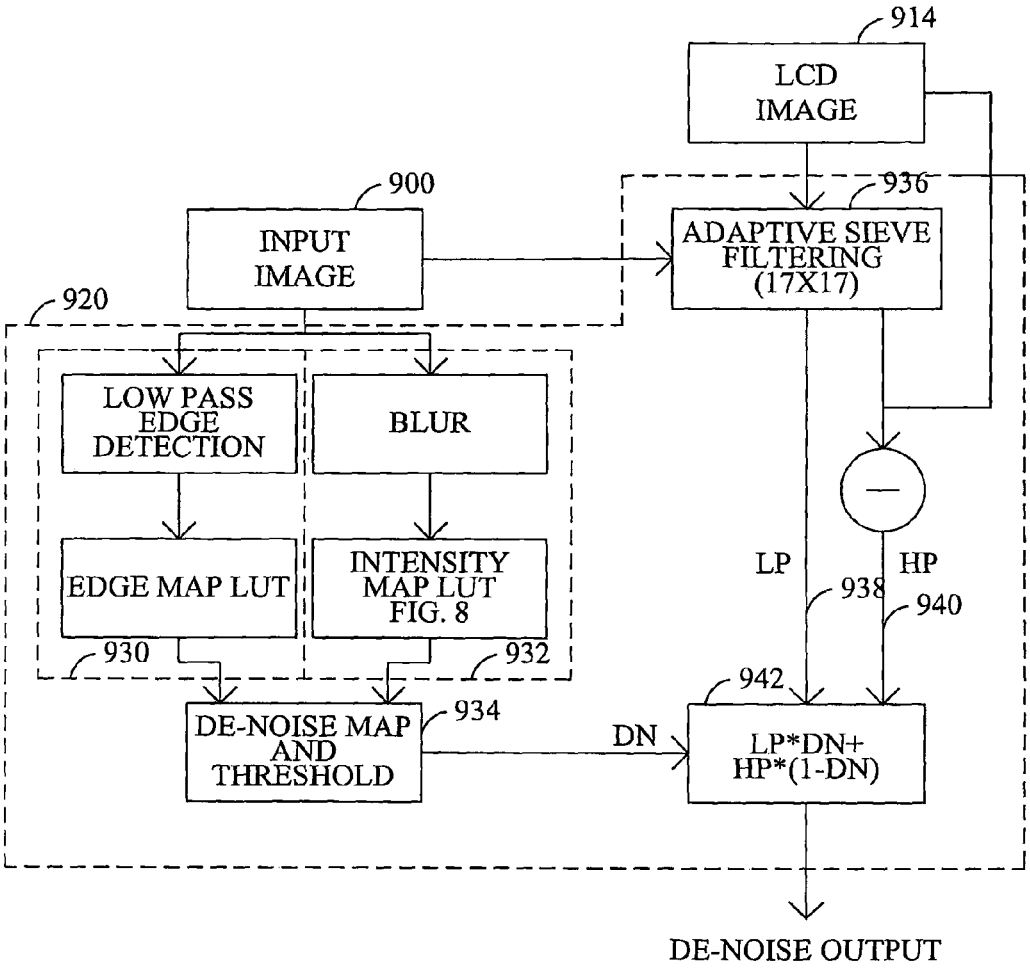
FIG. 10 illustrates a denoise block.

FIG. 10 illustrates the noise reduction process 920. The input image 900 is passed through an edge detection mapping process 930. The input image 900 is also based through a blurring mapping process 932 which is based upon the LED resolution of the display. A de-noise map is determined and a thresholding operation 934 is done. The LCD image 914 and the input image 900 is provided to a two-channel splitting filter 936. A low pass base channel 938 of the image is determined. A residual channel 940 of the image is determined. The output of the threshold operation 934, the base channel 938, and the residual channel 940 are combined together 942 to provide the filtered output 922.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A method for displaying an input image on a display comprising:

(a) receiving said input image to be displayed on said display and separating said input image into a backlight image and an LCD image, separation based at least in part on dividing said input image by said backlight image;

(b) determining a driving signal for a two-dimensional backlight array of independently selectable light emitting elements of said display by using a first process on said input image;

(c) determining a driving signal for a two-dimensional liquid crystal layer defining pixels of said display by using a second process that reduces noise present in pixel data of said input image, said second process occurring after said input image is divided by said backlight image and reducing noise based on gray-level data from said backlight array;

(d) wherein said two-dimensional backlight array has a density of light emitting elements that differs from the density of LCD elements in said two-dimensional liquid crystal layer defining said pixels of said display.

2. The method of claim 1 wherein said first process includes a non-linear filter.

3. The method of claim 1 wherein said first process sub-samples said input image.

4. The method of claim 1 wherein said first process includes a non-linear filter and sub-samples said input image.

5. The method of claim 4 further including up-sampling said input image as modified by said first process to substantially simulate the anticipated illumination from said backlight array.

6. The method of claim 5 further including the step of creating a liquid crystal layer image based upon said up-sampled input image and said input image.

7. The method of claim 6 wherein said liquid crystal layer image is filtered by said second process.

8. The method of claim 7 wherein said creating is based upon a division operation.

9. A method for displaying an input image on a display comprising:

(a) receiving said input image to be displayed on said display;

(b) using said input image to create a first signal suitable for driving a two-dimensional backlight array of independently selectable light emitting elements of said display and a second signal suitable for driving a two-dimensional liquid crystal layer defining pixels of said display, and dividing said second signal by a modified said input image;

(c) applying a noise reduction process to the divided said second signal, said noise reduction process reducing noise present in pixels of said input image.

10. The method of claim 9 wherein said first signal has been processed by a non-linear filter.

11. The method of claim 9 wherein said first signal has been processed by a sub-sampling process.

12. The method of claim 9 wherein said first signal has been processed by a non-linear filter and a sub-sampling process.

13. The method of claim 12 further including up-sampling said first signal to substantially simulate the anticipated illumination from said backlight array.

14. The method of claim 13 further including the step of creating a liquid crystal layer image based upon said up-sampled first signal and said input image.

15. The method of claim 9 wherein said separation is based upon a division operation.

* * * * *